US006216784B1

(12) United States Patent
Harrell

(10) Patent No.: US 6,216,784 B1
(45) Date of Patent: Apr. 17, 2001

(54) SUBSURFACE ELECTRO-HYDRAULIC POWER UNIT

(75) Inventor: John W. Harrell, Waxahacie, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 09/363,422

(22) Filed: Jul. 29, 1999

(51) Int. Cl.[7] ..... E21B 34/08

(52) U.S. Cl. ..... 166/250.15; 166/53; 166/66; 166/72

(58) Field of Search ..... 166/250.01, 250.15, 166/53, 66.6, 66.7, 68, 72, 325, 332.8, 321

(56) References Cited

U.S. PATENT DOCUMENTS

| | | | | |
|---|---|---|---|---|
| 4,038,632 | | 7/1977 | Parker . | |
| 4,617,960 | | 10/1986 | More . | |
| 4,667,736 | * | 5/1987 | Rumbaugh et al. | 166/65.1 |
| 4,712,613 | | 12/1987 | Niewoustad . | |
| 4,722,393 | | 2/1988 | Rumbaugh . | |
| 4,796,708 | | 1/1989 | Lembcke . | |
| 4,798,247 | * | 1/1989 | Deaton et al. | 166/66.7 |
| 4,805,657 | | 2/1989 | Carman et al. . | |
| 4,878,053 | | 10/1989 | Rordeu et al. . | |
| 4,896,722 | * | 1/1990 | Upchurch | 166/66.7 |
| 4,953,616 | | 9/1990 | Borden et al. . | |
| 5,166,677 | | 11/1992 | Scheonberg . | |
| 5,320,182 | | 6/1994 | Meudez . | |
| 5,358,035 | | 10/1994 | Grudzinski . | |
| 5,465,786 | | 11/1995 | Akkerman . | |
| 5,547,029 | | 8/1996 | Rubbo et al. . | |
| 5,597,042 | | 1/1997 | Tubel et al. . | |
| 5,706,892 | | 1/1998 | Aeschbachenle et al. . | |
| 5,706,896 | | 1/1998 | Tubel et al. . | |
| 5,732,776 | | 3/1998 | Tubel et al. . | |
| 5,789,665 | * | 8/1998 | Voelker et al. | 73/53.05 |
| 6,058,773 | * | 5/2000 | Zimmerman et al. | 73/152.24 |

* cited by examiner

*Primary Examiner*—William Neuder
(74) *Attorney, Agent, or Firm*—Paul I. Herman; Marlin R. Smith

(57) ABSTRACT

A subsurface electro-hydraulic power unit provided by the present invention permits existing hydraulically actuated well tools to be utilized in situations where control lines extending from the tools to the surface are undesirable or economically prohibitive. In a described embodiment, an electro-hydraulic power unit is in communication with a surface control system. The power unit may be supplied with electrical power from the surface control system, or it may include a power supply, such as batteries. The power unit may respond to a signal transmitted from the surface control system to select from among multiple redundant well tools for actuation thereof.

20 Claims, 4 Drawing Sheets

SUBSURFACE ELECTRO-HYDRAULIC POWER UNIT

BACKGROUND OF THE INVENTION

The present invention relates generally to operations performed in conjunction with subterranean wells and, in an embodiment described herein, more particularly provides a well control system utilizing a subsurface electro-hydraulic power unit.

It is common practice to control operation of a downhole hydraulically actuated well tool, such as a safety valve, from the earth's surface using fluid pressure transmitted from the surface to the tool via hydraulic lines, or control lines. Where the tool is within a few thousand feet of the surface, this method is quite satisfactory in practice. However, where the tool is located more than a few thousand feet deep in the well, hydrostatic pressure in the control lines, resistance to fluid flow through the control lines, the cost of running the control lines, the danger of damage to the control lines, the increased number of control line couplings and, therefore, potential leak paths, and other factors make this method unfeasible, or at least undesirable.

To solve this problem, hydraulically actuated well tools may be discarded in favor of electrically actuated well tools, or the hydraulically actuated well tools may be redesigned so that some other means is used to actuate the tools. Unfortunately, this solution to the problem requires that substantial costs be incurred in making changes to existing well tools having proven capabilities and reliable operation histories, etc.

Therefore, it may be readily seen that it would be quite desirable to provide a method whereby existing hydraulically actuated well tools may be remotely operated from the surface, without requiring use of hydraulic control lines extending between the surface and the tools.

SUMMARY OF THE INVENTION

In carrying out the principles of the present invention, in accordance with an embodiment thereof, a well control system and associated methods are provided which utilize a subsurface electro-hydraulic power unit. The power unit is at least partially controlled by a surface control system in communication therewith. The well control system may operate without the use of any hydraulic control lines extending between the surface control system and the power unit.

In one aspect of the present invention, the power unit includes a motor-driven pump which receives electrical power for its operation either from the surface control system via electric lines, or from an internal power source. The pump is connected to one or more well tools using control lines and, thus, no modification of existing control line operated well tools is required for their operation with the power unit.

In another aspect of the present invention, the power unit may be configured so that it selectively actuates redundant well tools. In this manner, a second well tool may be actuated by the power unit after a first well tool becomes incapable of performing its function. The power unit may include a valve which is operated in response to a signal transmitted from the surface control system to the power unit to select from among the redundant well tools for actuation thereof.

In yet another aspect of the present invention, the power unit may include features which conserve electrical power consumed by the power unit. These features may be particularly desirable where the power unit includes a power supply, such as batteries. In one such feature, the power unit may include a pressure transducer which is used to monitor the pressure of the pump output, thereby enabling the pump to be shut off when the pressure is in a predetermined acceptable range for actuating a certain well tool. In another such feature, a position sensor may be utilized in the well tool to monitor the position of a member of the tool, thereby enabling the pump to be shut off when the member is in a predetermined acceptable position or range of positions.

In still another aspect of the present invention, the power unit may include a reservoir for fluid pumped by the pump. A fluid quality sensor may monitor the quality of the fluid in the reservoir. An indication of fluid quality may be transmitted by the power unit to the surface control system.

These and other features, advantages, benefits and objects of the present invention will become apparent to one of ordinary skill in the art upon careful consideration of the detailed description of representative embodiments of the invention hereinbelow and the accompanying drawings.

DETAILED DESCRIPTION

Figure 1:
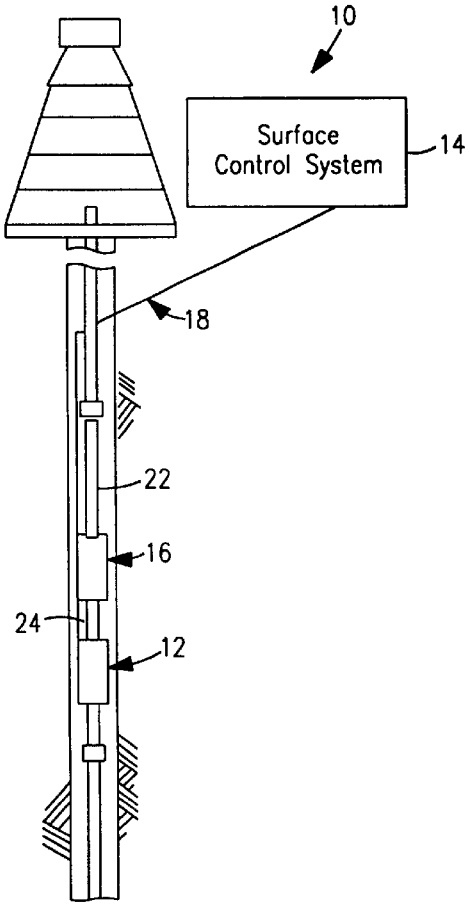
FIG. 1 is a schematic view of a first well control system embodying principles of the present invention.

Representatively illustrated in FIG. 1 is a well control system 10 which embodies principles of the present invention. In the following description of the well control system 10 and other apparatus and methods described herein, directional terms, such as "above", "below", "upper", "lower", etc., are used for convenience in referring to the accompanying drawings. Additionally, it is to be understood that the various embodiments of the present invention described herein may be utilized in various orientations, such as inclined, inverted, horizontal, vertical, etc., without departing from the principles of the present invention.

The well control system 10 is described herein as being utilized to control actuation of a hydraulically operated well tool 12, representatively a safety valve, in a manner that does not require running control lines from the surface to the tool, and that does not require modifications to the tool for such actuation. However, it is to be clearly understood that tools other than safety valves, such as sliding sleeve-type valves and tools other than valves, may be actuated by the well control system, and control lines or other hydraulic lines may be utilized in the system 10, without departing from the principles of the present invention.

The well control system 10 includes a surface control system 14 and a downhole electro-hydraulic power unit 16. The surface control system 14 is in communication with the power unit 16 by means of one or more electrical lines 18 extending therebetween. The power unit 16 may also be supplied with electrical power from the surface control system 14 via the lines 18, as described in more detail below. Alternatively, the power unit 16 may include a separate power supply 20, such as one or more batteries (see FIG. 4).

Note that the power unit 16 and the safety valve 12 are both interconnected in a tubular string 22 positioned in a well. In this manner, the power unit 16 and the safety valve 12 are in relatively close proximity to each other and one or more hydraulic lines 24 extending therebetween are relatively short, compared to the distance between the safety valve and the earth's surface. Thus, the problems associated with running, maintaining and utilizing very long hydraulic control lines are eliminated.

Figure 2:
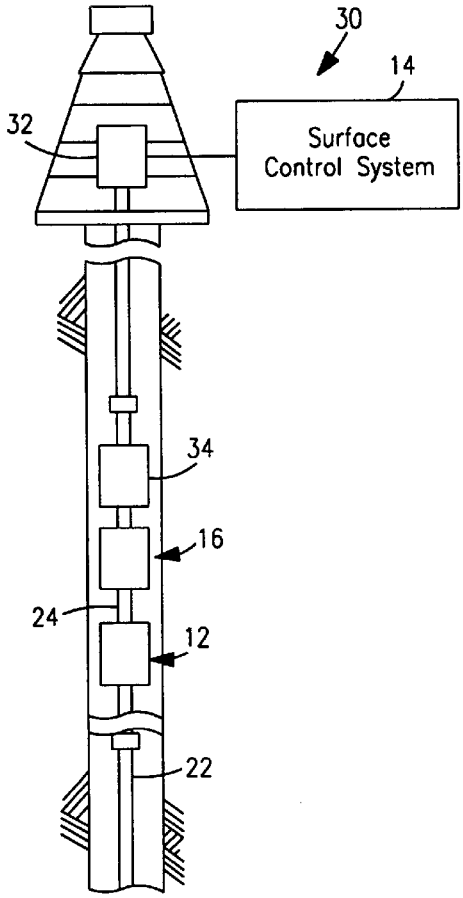
FIG. 2 is a schematic view of a second well control system embodying principles of the present invention.

In an alternate embodiment, communication between the surface control system 14 and the power unit 16 may be accomplished by means other than electrical lines 18, as representatively illustrated in FIG. 2. A well control system 30 depicted in FIG. 2 utilizes an acoustic transmitter/receiver 32 at the surface connected to, or incorporated in, the surface control system 14. A separate acoustic transmitter/receiver 34 is interconnected in the tubing string 22 and is connected to, or incorporated in, the power unit 16. Such acoustic transmitter/receivers 32, 34 may not necessarily both transmit and receive acoustic signals, since, for example, the one at the surface may only transmit signals and the one in the tubing string may only receive such signals, but it is preferred that two-way communication be used with the transmitter/receivers.

The acoustic transmitter/receivers 32, 34 may be any of those acoustic transmitters and/or receivers well known to those skilled in the art of remote data transmission in wells. Such acoustic transmitters and/or receivers communicate by transmission and reception of pressure pulses or acoustic waves including data-carrying signals.

Figure 3:
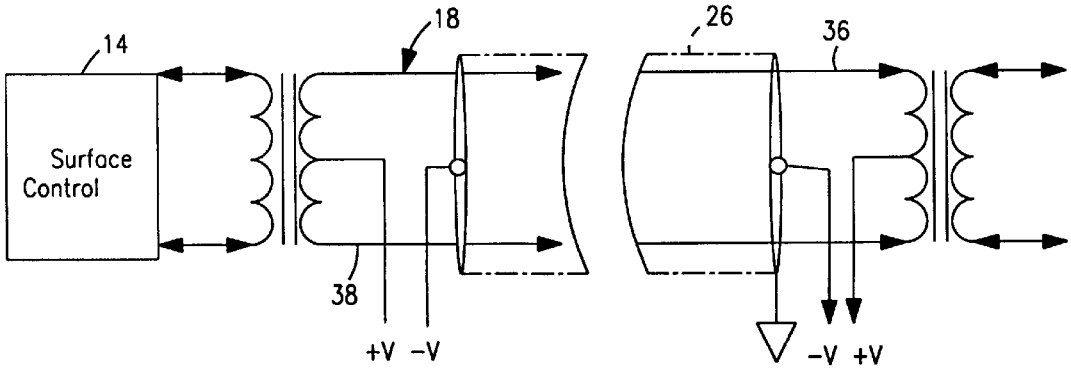
FIG. 3 is a schematic view of a communication and power transmission method which may be used in the first well control system.

Turning now to FIG. 3, the electrical lines 18 utilized in the method 10 are schematically shown extending from the surface control system 14. The representatively illustrated method of transmitting power and signals via the lines 18 is to be clearly understood as merely an example of the wide variety of such methods which may be used in the well control system 10. Many other power and signal transmission methods may be utilized, without departing from the principles of the present invention.

The lines 18 include a shield 26 connected to ground and two conductors 36, 38. The conductors 36, 38 are inductively coupled to the surface control system 14 at the surface, and to the power unit 16 downhole (see FIG. 4). This configuration is known as a phantom circuit and enables provision of signals superimposed on power transmitted via the lines 18.

Figure 4:
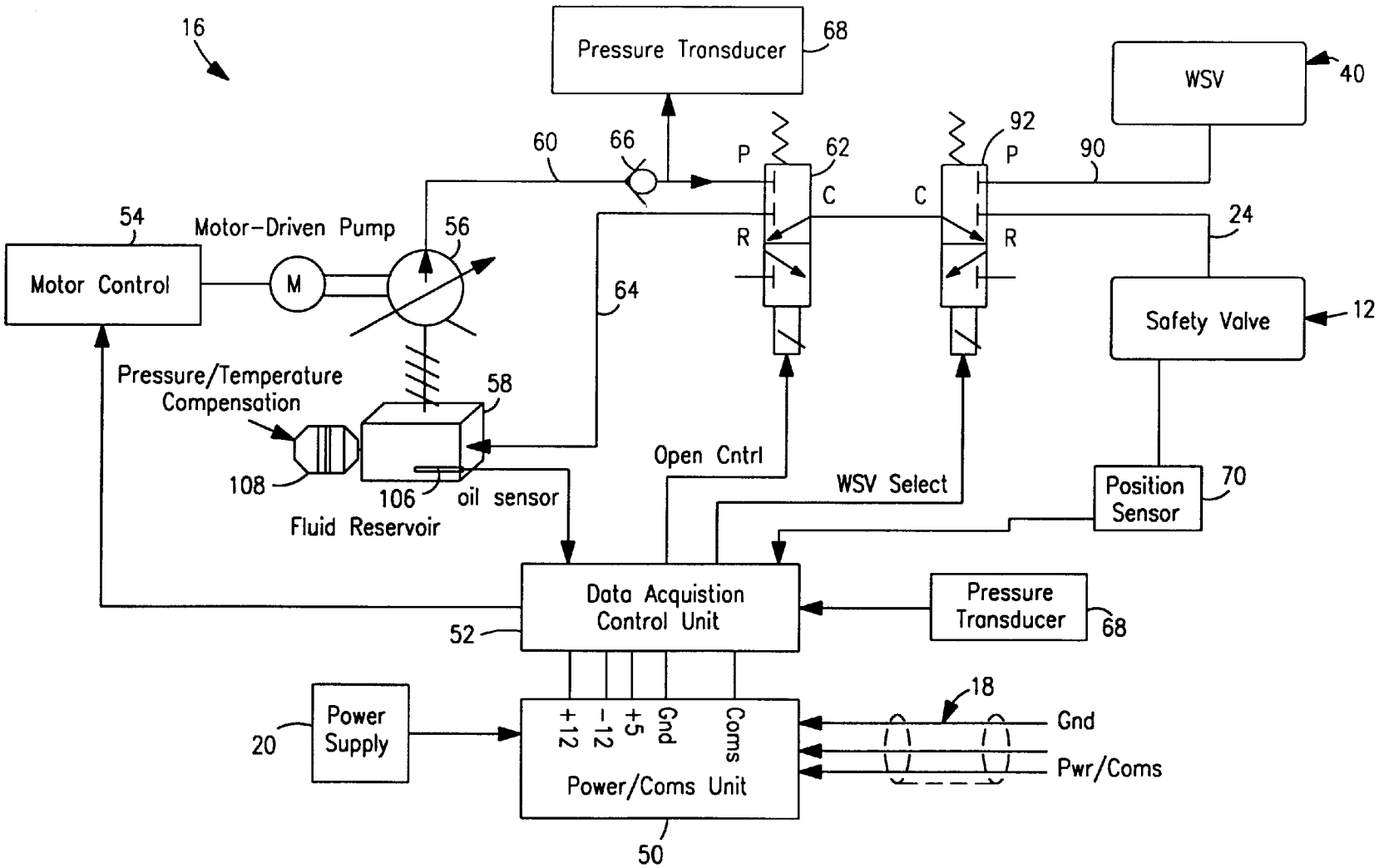
FIG. 4 is a schematic diagram of a downhole electro-hydraulic power unit which may be used in the first and second well control systems.

Referring additionally now to FIG. 4, a schematic of the downhole power unit 16 interconnected to the safety valve 12 and another safety valve 40 is representatively illustrated. The safety valve 40 is redundant to the safety valve 12, since it performs the same function. In actual practice, the safety valve 40 would not be utilized until the safety valve 12 becomes incapable of performing its function, for example, when the safety valve 12 can no longer properly shut off flow through the tubing string 22.

The safety valve 40 is indicated in FIG. 4 by the abbreviation "WSV", since it preferably includes a wireline conveyed safety valve 42 installed in a nipple 44 (see FIG. 5) after the safety valve 12, which is preferably a tubing conveyed safety valve, becomes incapable of performing its function. The nipple 44 is interconnected in the tubing string 22 along with the safety valve 12 when the tubing string is installed in the well. Alternatively, the safety valve 40 may be what is known to those skilled in the art as an insert valve, that is, it is inserted into the safety valve 12 when it becomes incapable of performing its function, as a remedial measure. However, it is to be clearly understood that the safety valves 12, 40 may be any type of safety valves, or any type of hydraulically actuated tools, may be different types of tools and not redundant, and may be conveyed into the well in any manner, without departing from the principles of the present invention.

The power unit 16 is connected to the lines 18 as described above for communication with the surface control system 14 and for provision of electrical power if the power unit 16 does not include the internal power supply 20. The lines 18 are connected to a power/communications unit 50. The power/communications unit 50 is connected to a data acquisition and control unit 52.

The data acquisition and control unit 52 is connected to a conventional motor control 54, which controls operation of a motor-driven pump 56. The pump 56 receives fluid from a reservoir 58 and pumps it at elevated pressure via an output line 60 to a solenoid valve 62. A return line 64 returns the fluid to the reservoir 5& A check valve 66 ensures that pressure in the line 60 does not bleed off back through the pump 56, thus helping to maintain elevated pressure in the line 60 downstream of the check valve. A pressure transducer or other pressure sensor 68 monitors pressure in the line 60 downstream of the check valve 66, and the output of the transducer is input to the data acquisition and control unit 52.

In the depicted power unit 16, the data acquisition and control unit 52 is programmed to maintain the pressure in the line 60 as indicated by the transducer 68 within an acceptable predetermined range for operation of the safety valve 12 or other tool connected thereto. For example, the data acquisition and control unit 52 may be programmed with a maximum pressure or upper pressure limit and a minimum pressure or lower pressure limit, so that the pump 56 is turned on when the pressure in the line 60 as indicated by the transducer 68 falls to the minimum pressure, and the pump is turned off when the pressure rises to the maximum pressure. Alternatively, such control of the pump operation may be implemented in the surface control system 14, with the pressure indications from the transducer 68 being transmitted to the surface via the lines 18.

It will be readily appreciated that this method of controlling operation of the pump 56 results in a significant reduction in power consumed by the pump 56, as compared to using a conventional pressure regulator to control the pump's output pressure. This reduction in power consumption is highly advantageous where the downhole power supply 20 is used to provide power to the pump 56.

One or both of the safety valves 12, 40 may have a position sensor 70, such as a hall effect device, proximity sensor, linear variable displacement transducer, etc., therein for monitoring the position of a member of the safety valve. For example, the position sensor 70 may indicate the position of an opening prong of the safety valve 12 and/or 40, to determine if the safety valve is fully open. The positioning and displacement of an opening prong or flow tube to open and close a safety valve is described in U.S. Pat. No. 5,465,786, the disclosure of which is incorporated herein by this reference.

The position sensor 70 is connected to the data acquisition and control unit 52. If it is desired to change the position of the member of the valve 12 and/or 40 that the position sensor 70 monitors, the data acquisition and control unit 52 will cause the pump 56 to deliver pressurized fluid to the line 60, and will actuate the solenoid valve 62 to effect the change in position.

In the representatively depicted power unit 16, the data acquisition and control unit 52 is programmed to maintain the position of the member as indicated by the sensor 70 in a predetermined position. The predetermined position may be a range of displacement relative to a reference point. For example, the data acquisition and control unit 52 may be programmed with a maximum displacement and a minimum displacement, so that the pump 56 is turned on when the position of the member is outside the displacement range, and the pump is turned off when the member is within the displacement range. Turning the pump 56 off when the valve member is in the predetermined position conserves power, which is particularly desirable when the power supply 20 is used to provide power to the power unit 16. Alternatively, such control of the pump operation may be implemented in the surface control system 14, with the position indications from the sensor 70 being transmitted to the surface via the lines 18.

Figure 6:
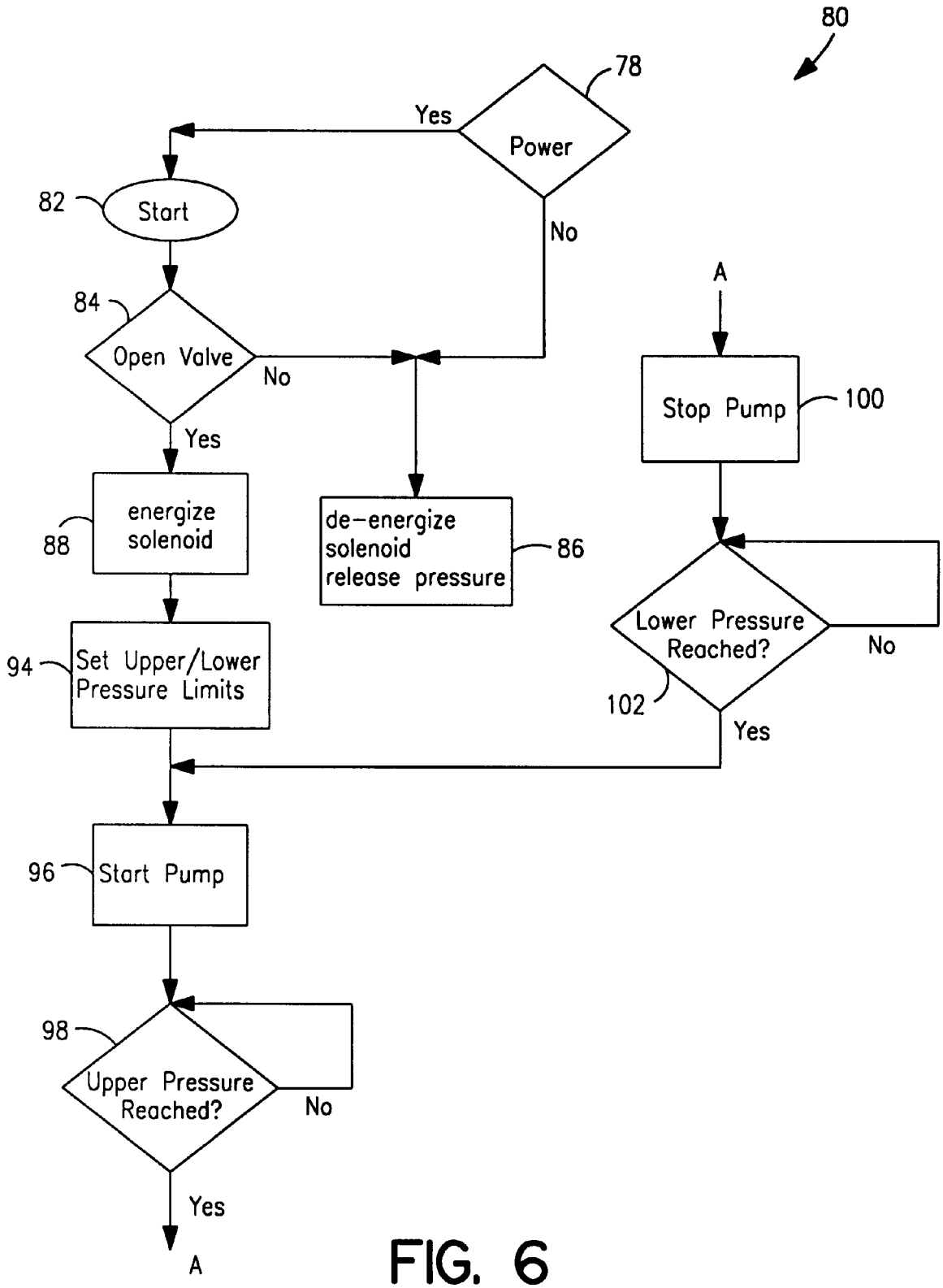
FIG. 6 is a flow chart of a pressure monitoring method which may be used in the power unit.

Referring additionally now to FIG. 6, a flow chart is depicted of a method 80 whereby the data acquisition and control unit 52 may be programmed to maintain pressure in the line 60 between the upper and lower pressure limits. It will be readily appreciated by one skilled in the art that a similar method may be used with the position sensor 70 to maintain the position of the member of the safety valve 12 and/or 40 within an acceptable predetermined range.

The method begins at the start step 82. In step 84, a decision is made whether to open the valve. As with most conventional safety valves, if sufficient pressure is not applied to an appropriate hydraulic control line, the valve will close, due to a biasing member, such as a spring, urging the valve to close. Thus, pressure need only be applied to the line 60 when it is desired to open the valve, or to maintain the valve in its open position. The decision in step 84 whether to open the valve may be made internally in the power unit 16, or it may be the result of an instruction transmitted to the power unit from the surface control system 14.

If the decision in step 84 is to close the valve, the program goes to step 86. Step 86 results in power being removed from the solenoid valve 62 by the data acquisition and control unit 52. Step 86 also follows step 78 if no power is supplied to the power unit 16. When no power is supplied to the solenoid valve 62, it connects the output line 60 directly to the return line 64. Thus, even if pressure exists in the line 60 when the decision is made to close the valve, this pressure will be relieved when no power is supplied to the solenoid valve 62 and the valve will be permitted to close.

If the decision in step 84 is to open the valve, the program goes to step 88 in which the solenoid valve 62 is energized. This connects the output line 60 to the line 24. Pressure in the line 60 is now delivered to the valve 12. Note that the pressure in line 60 could alternatively be delivered to the valve 40 via a line 90 if another solenoid valve 92 is actuated by the data acquisition and control unit 52, as described in more detail below.

In step 94, the upper and lower pressure limits are set. For example, it may be known that a certain pressure is needed to open the valve, and that a certain greater pressure may cause damage to the valve. In that case, the lower limit may be set somewhat above the opening pressure, and the upper limit may be set somewhat below the damaging pressure. The pressure limits may be preprogrammed in the data acquisition and control unit 52 prior to installing the power unit 16, the pressure limits may be transmitted to the power unit by the surface control system 14 after the power unit is installed, or any other method may be used for setting the pressure limits.

If the pressure in the line 60 as indicated by the pressure transducer 68 is below the lower limit, as it should be upon initial opening of the valve, the pump 56 is started in step 96. In step 98, if the upper pressure limit is not yet reached, the pump 56 remains operating. When, however, the upper pressure limit is reached, the pump 56 is stopped in step 100.

At this point, due to temperature fluctuations, leakage, etc., the pressure in the line 60 as indicated by the transducer 68 may decrease. The pressure indication from the transducer 68 is monitored by the data acquisition and control unit 52 in step 102, and if the lower pressure limit is reached, the pump 56 is again started in step 96. In this manner, the pressure in the line 60 as indicated by the transducer 68 is maintained between the upper and lower pressure limits by the data acquisition and control unit 52. Alternatively, some or all of these control functions may be performed by the surface control system 14, with the data acquisition and control unit 52 merely functioning to receive data from the sensors 68, 70 and carry out instructions transmitted from the surface control system.

It will be readily appreciated by one skilled in the art that the method 80 may alternatively be used to control the position of a valve member, such as an opening prong of a conventional safety valve or a sleeve of a sliding sleeve valve, as indicated by the position sensor 70. For example, the pump 56 may be operated when the member is outside of a predetermined position, as defined by upper and lower displacement limits, and the pump may be deactivated when the member is in the predetermined position. In that case, the upper and lower displacement limits would be substituted for the upper and lower pressure limits shown in FIG. 6. Thus, the method 80 may be used to control a variety of aspects of operation of well tools.

Referring again to FIG. 4, the reservoir 58 has a fluid quality sensor or oil sensor 106 therein. The sensor 106 may be a conductivity or a dielectric sensor, or another type of sensor. The sensor 106 is utilized in the power unit 16 to detect the quality of the fluid in the reservoir 58, for example, to determine whether well fluids have invaded the reservoir fluid. The reservoir fluid may be oil and the sensor 106 may be capable of detecting whether water has become mixed with the oil or is otherwise present in the reservoir. The sensor 106 is connected to the data acquisition and control unit 52, and the indications of fluid quality from the sensor may be transmitted to the surface control system 14 via the power/communications unit 50.

A pressure/temperature compensation device 108 is connected to the reservoir 58. The device 108 may be a floating piston which acts to increase or decrease the volume of the reservoir 58 as the reservoir fluid expands or compresses due to a change in temperature or pressure, etc. Preferably, the device 108 acts to maintain the pressure of the fluid in the reservoir at the hydrostatic pressure in the well.

The solenoid valve 92 is used in the power unit 16 to control to which of the valves 12, 40 fluid pressure is delivered from the line 60. Of course, if the solenoid valve 62 is not actuated by the data acquisition and control unit 52, neither of the lines 24, 90 may be connected to the line 60. Thus, to deliver pressurized fluid from the line 60 to the valve 12, the solenoid valve 62 is actuated and the solenoid valve 92 is not actuated, thereby connecting the line 60 to the line 24. To deliver pressurized fluid from the line 60 to the valve 40, the solenoid valve 62 is actuated and the solenoid valve 92 is actuated, thereby connecting the line 60 to the line 90. Note that, to deliver pressurized fluid to either of the valves 12, 40, the solenoid valve 62 must be actuated and, therefore, a fail-safe condition is presented, since neither valve may be opened if electrical power to the power/communications unit 50 is interrupted.

Figure 5:
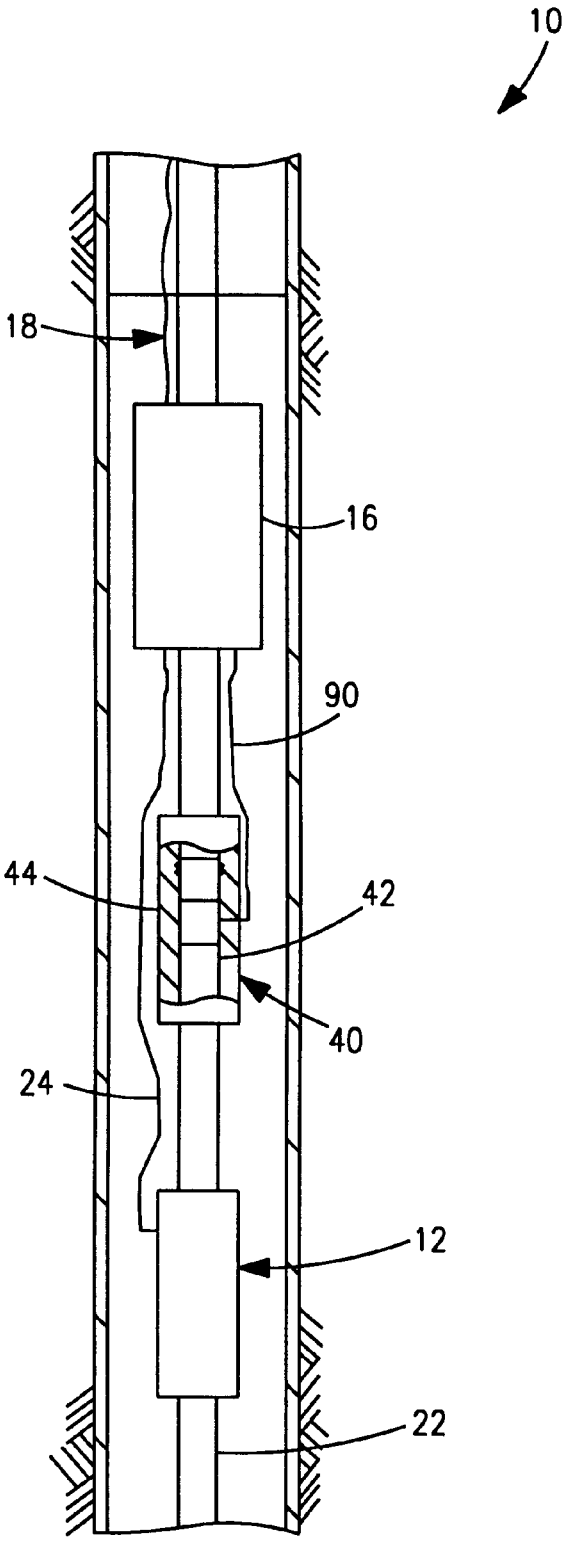
FIG. 5 is a partially cross-sectional view of an optional redundant well tool control method which may be used in the first and second well control systems.

The description above of the operation of the solenoid valve 92 to select from among redundant well tools 12, 40 may be further illustrated by referring to FIG. 5. Recall that the tubing string 22 as illustrated in FIG. 5 includes a separate nipple 44 for landing therein of a safety valve 42. When the tubing string 22 is initially installed, the safety valve 42 is not present in the nipple 44. Instead, the safety valve 12 initially performs the function of preventing flow through the tubing string 22 if desired.

At this point, the valve 12 is opened by actuating the solenoid valve 62 and delivering pressurized fluid from the line 60 to the line 24 as described above, without actuating the solenoid valve 92. To close the valve 12, the solenoid valve 62 is deactivated, thereby connecting the line 24 to the return line 64 and relieving pressure in the line 24.

If the valve 12 should become incapable of performing its function, the valve 42 may be installed in the nipple 44 and operated by actuating the solenoid valve 92. With the solenoid valve 92 actuated, operation of the valve 40 is the same as described above for the valve 12.

The power unit 16 has been described above as it is used to operate the redundant valves 12, 40. However, it is to be clearly understood that the power unit 16 may be otherwise utilized, without departing from the principles of the present invention. For example, only one valve 12 could be operated by the power unit 16. In that case, the solenoid valve 92 could be eliminated from the power unit 16. As another example, the lines 24, 90 would be used to operate another well tool, such as a sliding sleeve-type valve. In that case, pressurized fluid could be applied to the line 90 to bias a sleeve of the sliding sleeve valve to an open position, and pressurized fluid could be applied to the line 24 to bias the sleeve to a closed position The position sensor 70 could be used to monitor the position of the sleeve. Thus, principles of the present invention may be utilized to control operation of a wide variety of well tools.

Of course, a person skilled in the art would, upon a careful consideration of the above description of representative embodiments of the invention, readily appreciate that many modifications, additions, substitutions, deletions, and other changes may be made to these specific embodiments, and such changes are contemplated by the principles of the present invention. Accordingly, the foregoing detailed description is to be clearly understood as being given by way of illustration and example only, the spirit and scope of the present invention being limited solely by the appended claims.

What is claimed is:

1. An electro-hydraulic well control system, comprising:

a downhole electro-hydraulic power unit in communication with, and at least partially controlled by, a surface control system;

a first hydraulically actuated tool interconnected in a tubular string and hydraulically connected to the power unit; and a second hydraulically actuated tool interconnected in the tubular string and hydraulically connected to the power unit, and the second tool performing a function redundant to that of the first tool, the power unit actuating the second tool to perform the function when the first tool is incapable of performing the function.

2. The well control system according to claim 1, wherein the first tool is a first safety valve threadedly interconnected in the tubular string, and wherein the second tool is a second safety valve reciprocably disposed and releasably secured within the tubular string.

3. The well control system according to claim 1, wherein a valve of the power unit is operated to select one of the first and second tools for actuation thereof by the power unit in response to a signal transmitted from the surface control system to the power unit.

4. The well control system according to claim 3, wherein the signal is transmitted via lines extending between the surface control system and the power unit.

5. The well control system according to claim 3, wherein the signal is transmitted via pressure pulses from the surface control system to the power unit.

6. The well control system according to claim 3, wherein the signal is transmitted via acoustic waves from the surface control system to the power unit.

7. The well control system according to claim 1, wherein the power unit includes a motor-driven pump powered by electricity delivered from the surface control system to the power unit, and wherein an output of the pump is connected to a selected one of the first and second tools in response to a signal transmitted from the surface control system to the power unit.

8. The well control system according to claim 1, wherein the power unit includes a motor-driven pump internally powered by the power unit, and wherein an output of the pump is connected to a selected one of the first and second tools in response to a signal transmitted from the surface control system to the power unit.

9. A method of controlling well tools installed in a subterranean well, the method comprising the steps of:

interconnecting first and second hydraulically actuated tools and a downhole electro-hydraulic power unit in a tubular string, the second tool performing a function redundant to that of the first tool;

positioning the tubular string in the well;

establishing communication between the power unit and a surface control system; and transmitting a signal from the surface control system to the power unit to thereby cause the power unit to actuate the second tool when the first tool is incapable of performing the function.

10. The method according to claim 9, wherein the first and second tools are safety valves and further comprising the steps of inserting the second tool into the tubular string and interconnecting the second tool to the power unit after the first tool is incapable of performing the function.

11. The method according to claim 9, wherein the transmitting step further comprises transmitting the signal via lines extending between the surface control system and the power unit.

12. The method according to claim 9, wherein the transmitting step further comprises transmitting the signal via pressure pulses.

13. The method according to claim 9, wherein the transmitting step further comprises transmitting the signal via acoustic waves.

14. The method according to claim 9, wherein the transmitting step further comprises directing an output of a motor-driven pump of the power unit from the first tool to the second tool in response to the signal.

15. An electro-hydraulic well control system, comprising:

a downhole power unit interconnected in a tubular string positioned in a well, the power unit including a pump and a fluid reservoir connected to the pump, the power unit further including a fluid quality sensor connected to the reservoir; and a surface control system in communication with the power unit, the surface control system receiving an indication of quality of fluid in the reservoir from the fluid quality sensor.

16. The well control system according to claim 15, wherein the fluid quality sensor is a conductivity sensor.

17. The well control system according to claim 15, wherein the fluid quality sensor is a dielectric sensor.

18. An electro-hydraulic well control system, comprising:

a surface control system; and a downhole power unit in communication with the surface control system and interconnected in a tubular string positioned in a well, the power unit including a pump having an output connected to a pressure sensor of the power unit and to a hydraulically actuated tool interconnected in the tubular string, the pump ceasing to operate in response to an indication from the pressure sensor that a pressure has been produced by the pump that is in a predetermined range to actuate the tool.

19. The well control system according to claim 18, wherein the pump begins to operate in response to an indication from the pressure sensor that the pump output is outside of the predetermined pressure range.

20. The well control system according to claim 18, wherein the power unit includes a power supply, and wherein the cessation of operation of the pump in response to the pressure sensor indication reduces a rate of power draw from the power supply.

* * * * *